US008701242B2

(12) United States Patent
DeHart

(10) Patent No.: US 8,701,242 B2
(45) Date of Patent: Apr. 22, 2014

(54) PAINT ROLLER TRAY WITH FOOT RAISABLE BAIL HANDLE

(76) Inventor: Damon H DeHart, Bedford, MA (US)

( * ) Notice: Subject to any disclaimer, the term of this patent is extended or adjusted under 35 U.S.C. 154(b) by 713 days.

(21) Appl. No.: 12/798,541

(22) Filed: Apr. 6, 2010

(65) Prior Publication Data

US 2010/0266767 A1 Oct. 21, 2010

Related U.S. Application Data

(60) Provisional application No. 61/212,055, filed on Apr. 6, 2009.

(51) Int. Cl.
*B05C 21/00* (2006.01)

(52) U.S. Cl.
USPC ..... 15/257.05; 220/570

(58) Field of Classification Search
USPC ..... 15/257.05, 257.06; 220/570
See application file for complete search history.

(56) References Cited

U.S. PATENT DOCUMENTS 2,810,148 A 10/1957 Wood, Jr.
4,023,702 A 5/1977 McKnight
4,164,803 A 8/1979 Zurawin
4,205,411 A 6/1980 Cupp
D297,676 S 9/1988 Ross
4,815,604 A 3/1989 O'Neil
5,400,916 A 3/1995 Weber
5,509,169 A * 4/1996 Drucker ..... 15/257.06
5,553,701 A 9/1996 Jarecki
6,019,241 A 2/2000 Burns
7,410,074 B1 * 8/2008 Brunning ..... 220/570

* cited by examiner

*Primary Examiner* — Randall Chin
(74) *Attorney, Agent, or Firm* — Kriegsman & Kriegsman

(57) ABSTRACT

A paint roller tray (20) includes a pivoting bail handle (21) attached thereto. The bail handle (21) is horizontally disposed in a default position while the tray (20) is being used for painting. The handle pivots with respect to the tray (20) to move a handle portion upward for easy one hand grasping by a user. The bail handle includes foot extensions (72) and (73) that extend outboard of the tray (20) that a user can step on to pivot the bail handle (21) to a lift position for easier grasping. The tray (20) includes a paint brush rest surface (35) and one or more brush handle holders (36) and (37) to secure the brush handle and prevent the brush from falling as the tray is moved. The tray (20) further includes elements (44-49) for cantilevering the tray from the rung of a step ladder and is configured for nesting one tray inside another.

12 Claims, 3 Drawing Sheets

PAINT ROLLER TRAY WITH FOOT RAISABLE BAIL HANDLE

This application claims the benefit of the priority of U.S. provisional application 61/212,055, filed Apr. 6, 2009, which is incorporated herein by reference.

BACKGROUND OF THE INVENTION

1. Field of the Invention

The present invention relates generally to a paint roller tray configured with a pivoting bail handle suitable for lifting the tray with one hand. More specifically, the bail handle includes one or two extensions disposed outboard of the transverse width of the tray and the extensions provide a foot actuator that can be stepped on to pivot the bail handle to a convenient lift position.

2. Description of the Related Art

Trays for use with paint rollers are well known. Some examples are disclosed as follows. Burns, U.S. Pat. No. 6,019,241 and Cupp, U.S. Pat. No. 4,205,411 both disclose reclining handles that suffer from the need to stoop down low to pick up the handle when the tray is on a floor. Ross, U.S. Pat. No. D. 297,676 and McKnight, U.S. Pat. No. 4,023,702 suffer from a lack of nesting causing storage, packaging and display to be bulkier and take up more space. Weber, U.S. Pat. No. 5,400,916 and Brunning, U.S. Pat. No. 7,410,074 suffer from a lack of paint brush holder inside the tray requiring the user to find an alternate place for the paint brush. O'Neil, U.S. Pat. No. 4,815,604 although offering fit up legs for mounting to a stepladder, suffer from lack of robustness as the tray legs are attached outwardly, supported only on one side, not robustly as are the current invention's engaging legs being supported by the skirt flange along the full periphery of the engaging legs' U shape cross section.

These examples of the prior art suffer from a lack of a convenient handle that can be grasped with one hand while holding a paint roller in the other hand. The examples further lack other features for ease of use that are described below.

SUMMARY OF THE INVENTION

The present invention overcomes the problems cited in the prior art by providing a paint roller tray that has a handle suitable for carrying with one hand.

It is also an object of the invention to provide a paint roller tray having a reclining handle so that when placed on a floor, the reclining handle can be activated by a foot, to be raised to a generally upright position and easily grasped without the need for stooping.

It is also an object of the invention to provide a paint roller tray that is stackable and nestable when a plurality of trays are placed atop each other.

It is also an object of the invention to provide one or more of a paint brush holder, a brush resting area above the paint roller well area, a paint brush scraper to remove excess paint from the brush and a pour spout to empty excess paint.

It is also an object of the invention to provide engaging legs to allow mounting onto the steps and top platform of a stepladder.

Other objects and advantages of the invention will become apparent from the following description of the invention.

BRIEF DESCRIPTION OF THE DRAWINGS

The features of the present invention will best be understood from a detailed description of the invention and a preferred embodiment thereof selected for the purposes of illustration and shown in the accompanying drawings in which.

DESCRIPTION OF THE PREFERRED EMBODIMENTS

Figure 1:
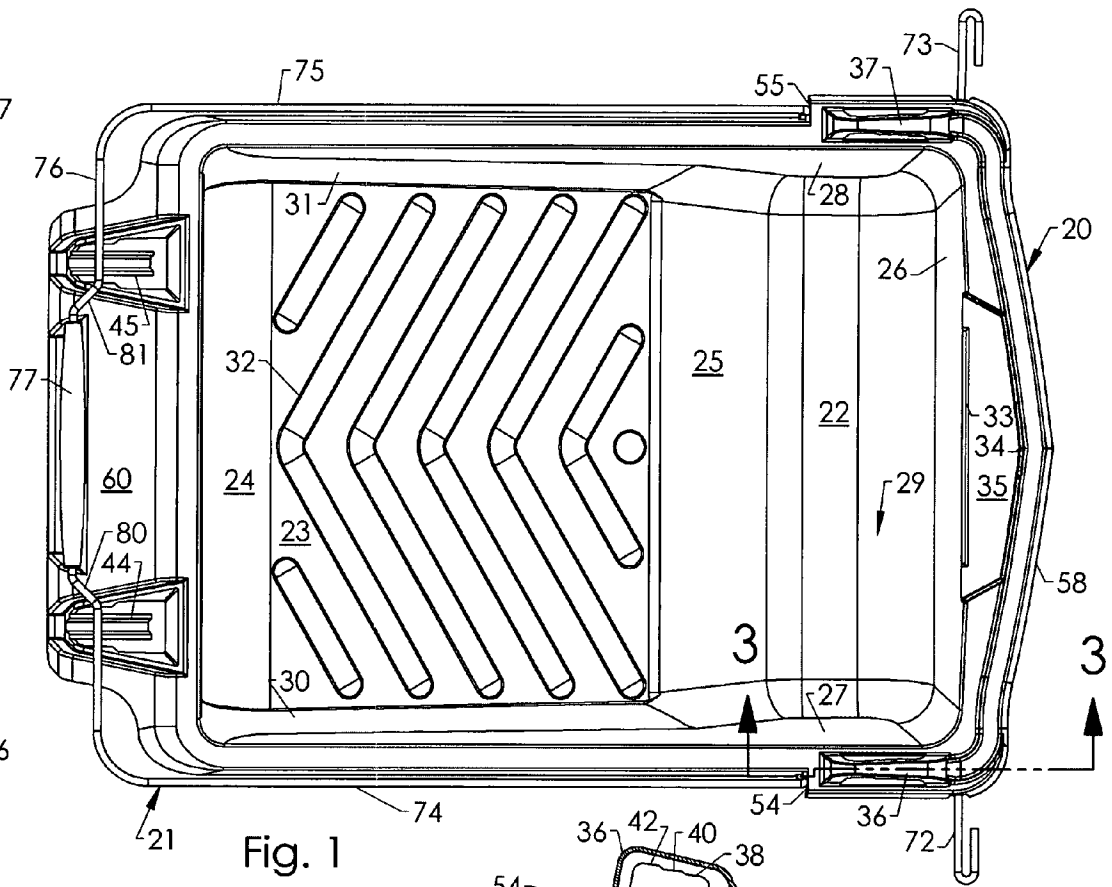
FIG. 1 is a top plan view of the tray assembly.
Figure 2:
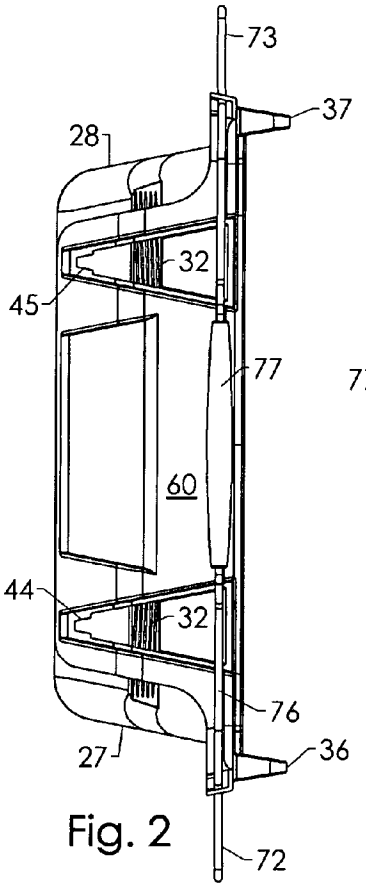
FIG. 2 is a back end plan view of the tray assembly.

Referring to FIGS. 1-8, in which like reference numbers are used to describe like elements, a paint tray (20) and an attached bale handle (21) of the present invention are shown in a top plan view in FIG. 1 with the bail handle (21) disposed in its default reclined or substantially horizontal position. The tray (20) is configured to hold paint or another liquid in a reservoir (29). The reservoir (29) is open at a top end thereof and has a transverse width sized to receive a conventional paint roller of a desired width into the reservoir to apply paint or other liquids from the reservoir (29) onto the paint roller for painting or otherwise rolling the liquid onto a surface to be painted. The attached bail handle (21) comprises a wire form element that is pivotally attached to the tray (20) at a front end thereof. Preferably the wire is round metal wire but other shapes and materials are usable without deviating from the present invention. The bail handle (21) includes a grip sleeve (77) that a user may grasp to lift the paint tray (20). In the default reclined position, the grip sleeve (77) rests at a back end of the tray (20) outboard of the reservoir (29).

The bail handle (21) includes a pair of foot actuator extensions (72) and (73) that extend beyond the transverse width of the tray (20) on each side thereof. Alternatively, only one foot actuator extension is provided. Either one of the foot actuator extension (72) and (73) may be stepped on to pivot the bail handle (21) and lift the grip sleeve (77) to a convenient height for a user to grasp for picking up the tray (20).

The tray (20) is formed with a peripheral flange lip (59) that surrounds the open top end of the reservoir (29). The lip (59) stiffens the tray (20) to prevent twisting and bending of the tray (20) or the reservoir (29) when the tray (20) is lifted by the bail handle (21), lifted by the peripheral flange lip (59) or when the tray is cantilevered e.g. from a ladder rung during use.

In the preferred embodiment the tray (20) is formed as a unitary element comprising formable plastic such as high density polyethylene, polypropylene or other suitable material. Alternately the tray (20) may comprise metal or various fibrous composite materials such as glass or carbon fibers encased in an epoxy base material. The reservoir (29) and the tray (20) may be formed with a variety of shapes and sizes as required to cooperate with various paint roller configurations without deviating from the present invention.

Figure 5:
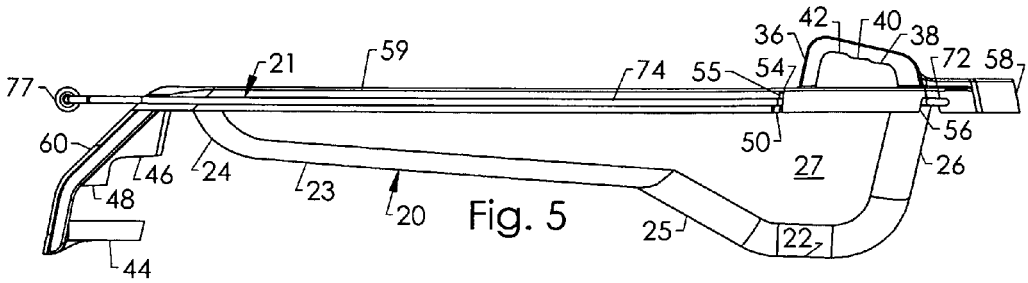
FIG. 5 is a right side plan view of the tray assembly.
Figure 6:
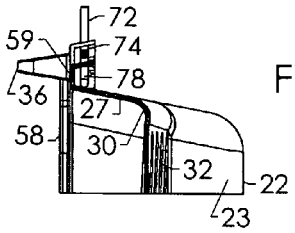
FIG. 6 is a partial sectional view showing the trough detail.
Figure 4:
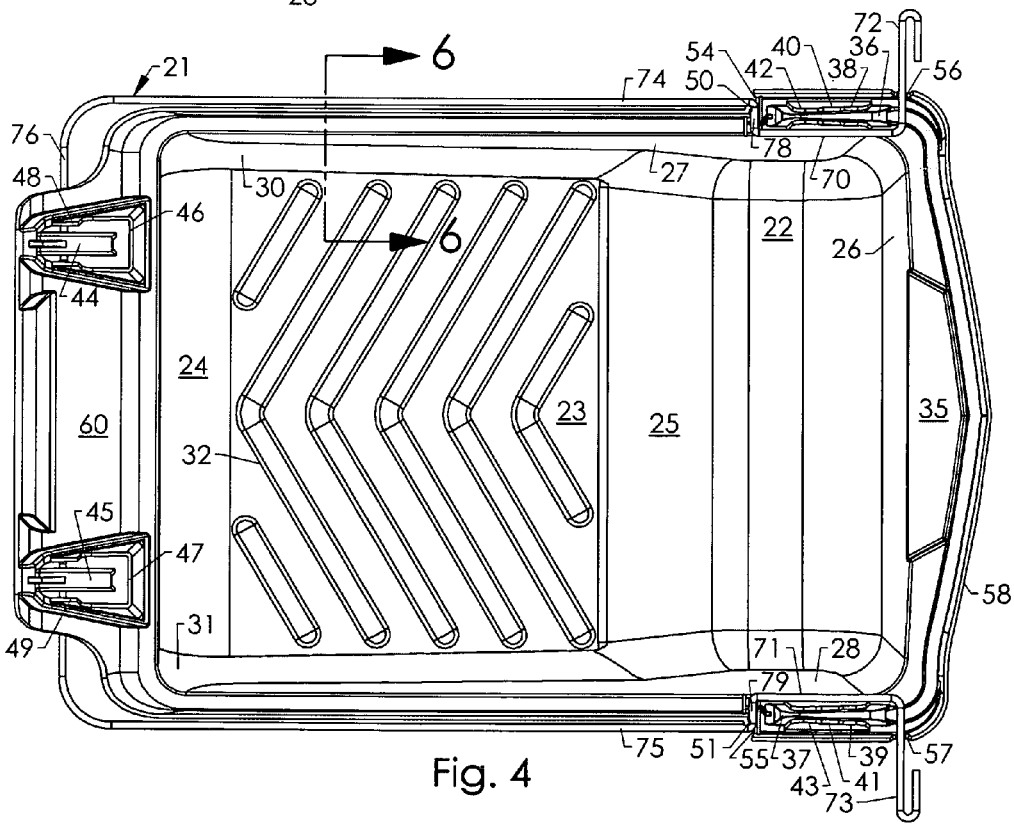
FIG. 4 is a bottom plan view of the tray assembly.

As best viewed in FIGS. 4 and 5, the tray (20) is bounded by a plurality of walls, originating from the peripheral flange lip (59) and descending downward therefrom, including a front wall (26), opposing right and left side walls (27) and (28) and a base wall. As best viewed in FIG. 5, the base wall includes a substantially horizontal deep well base (22), a sloped transition wall (25), an inclined rollout shelf (23), and a rear wall (24). In addition, the base wall includes drain troughs (30) and (31) disposed between the side walls (27 and (28) and the inclined rollout shelf (23) and the troughs (30) and (31) are shaped to drain paint toward the deep wall base (22).

Each of the front wall (26), the side walls (27) and (28) and the rear wall (24) extend downward from the peripheral flange lip (59) with a slight inward draft angle that narrows the tray from top to bottom. The draft angle may be selected according to the draft required by the forming process used to form the tray (20). The deep well base (22), sloped transition wall (25), front portion of side walls (27) and (28) and lower portion of the front wall (26) substantially form the reservoir (29) that holds a paint supply. Preferably, the depth of the reservoir at the deep well base (22) supports a paint roller resting therein with the top of the paint roller remaining below a top surface of the peripheral lip (59). A paint roller placed on the inclined roll out shelf (23) is rolled into the reservoir (29) to absorb or wick paint into the roller. The roller may then be rolled back up the inclined roll out shelf (23) to remove excess paint from the roller. The inclined roll out shelf (23) is formed with a plurality of raised and diagonally inclined ribs (32) which function to provide traction to the paint roller and to direct excess paint flow toward right and left paint troughs (30) and (31). The paint troughs (30) and (31) comprise semicircular troughs that slope toward the reservoir (29). The paint troughs (30) and (31) are formed between the side walls (27) and (28) and the inclined roll out shelf (23) below the level of the inclined roll out shelf (23).

The deep well base (22) serves as a tray support surface and cooperates with a support skirt (60) that extends down from the rear of the tray (20) to support the tray with the top surface of the flange lip (59) substantially horizontal when the tray (20) is disposed on a horizontal surface. Otherwise, as will be described below, the tray (20) can be horizontally cantilevered from a step ladder rung during use.

The tray (20) optionally includes a substantially horizontal paint brush support surface (35) located at the top of the front wall (26). The support surface (35) has the same elevation or is slightly below the top surface the flange lip (59). The brush support surface (35) is suitable for resting the bristles of a paint brush thereon and is formed to ensure that any excess paint that drips out of the paint brush bristles onto the support surface (35) drains into the reservoir (29). A raised scraper rib (33) is optionally formed along a back edge of the brush support (35) for scraping excess paint from the bristles of the paint brush. A front flange lip (58) may extend vertically up from the support surface (35) and the peripheral lip (59) to contain paint on the support surface (35). The front flange lip (58) may also form a v-shaped pour spout (34) for pouring paint out of the reservoir (29), e.g. back into a paint can.

Figure 3:
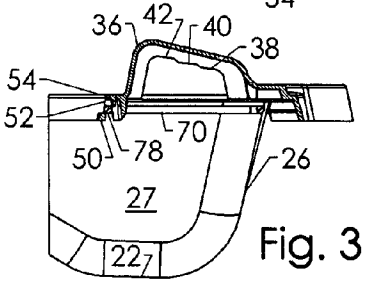
FIG. 3 is a partial right side sectional view showing detail of the handle pivot area and paint brush holder.
Figure 7:
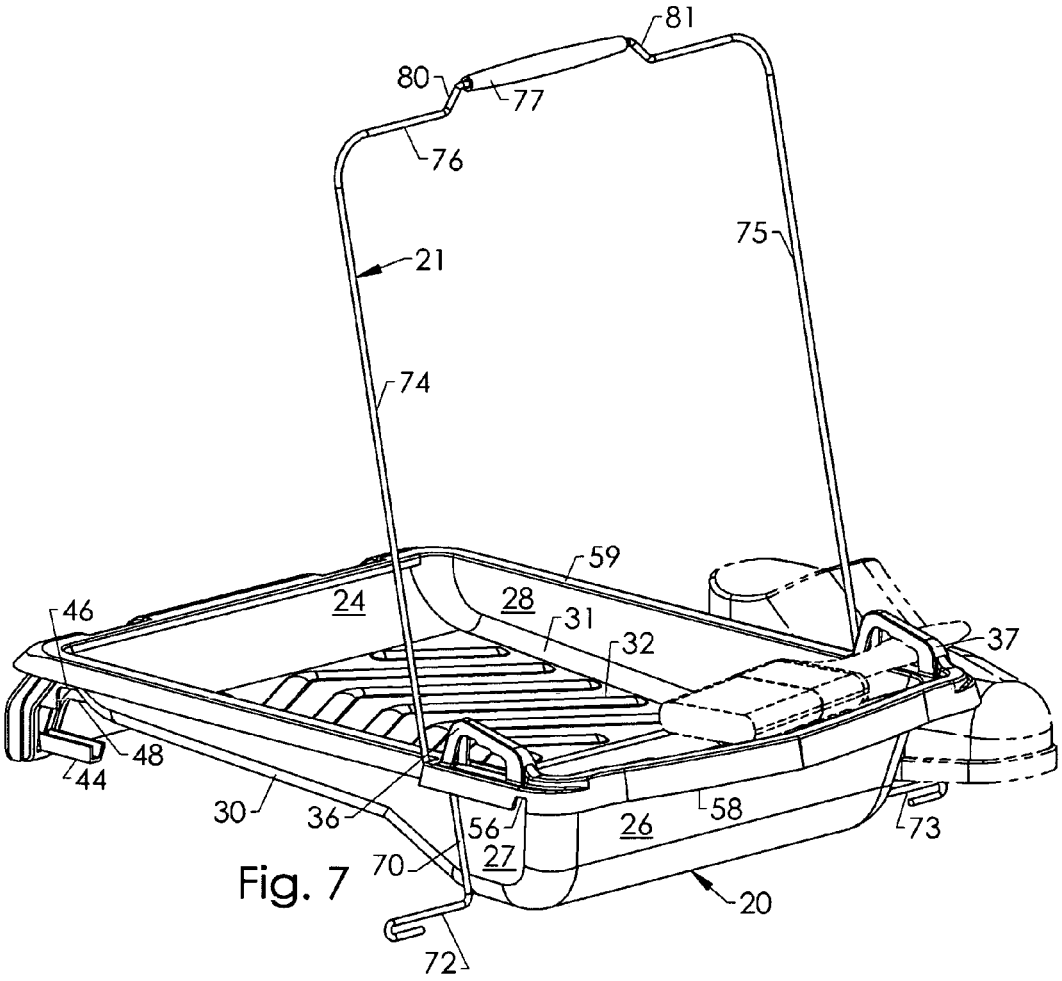
FIG. 7 is a perspective view of the top, front end and right side of the tray with the handle raised by means of a foot and also showing a paint brush being held in the brush holder.

Referring to FIGS. 3 and 7, the tray (20) may also include a right brush handle holder (36) and/or a left brush handle holder (37) for capturing and holding the handle of the paint brush while the paint brush rests on the support surface (35). In particular each brush handle holder (36) and (37) may comprise an arch shaped ring that extends vertically upward from the peripheral flange lip (59) and forms a through aperture between an underside of the arch shaped ring and the top surface of the peripheral flange lip (59). In addition, the arch shaped ring is formed with one or more inclined cam portions facing the top surface of the peripheral flange lip (59) and each inclined cam portion provides a different through aperture opening size that can be used to capture different sized brush handles therein. In particular, the left brush holder (37) includes inclined cams (39), (41) and (43) and the right brush holder (37) includes cams (38), (40) and (42). The cams (38) and (39) provide small openings for small brush handles. The cams (42) and (43) provide larger openings for larger brush handles. A brush handle may be forced into the smallest opening that it will fit into to secure the handle in place. Alternately the number of inclined cams may be greater or less than three without deviating from the present invention. Alternately, the inclined cams could be formed to extend vertically up from the peripheral flange lip (59) within said brush holders (36) and (37).

Referring now to FIGS. 4 and 5, the tray (20) further includes a pair of engaging legs (44) and (45) extending horizontally from opposing left and right sides of the support skirt (60). The engaging legs (44) and (45) are provided to engage with the underside of a ladder rung or the like to cantilever the tray (20) horizontally from the ladder rung. Right engaging leg (44) and left engaging leg (45) originate from the support skirt (60) and protrude horizontally toward the front of tray (20). The engaging legs (44) and (45) are formed with a U shape cross section with the entire cross-section peripheral attached to support skirt (60) to offer robust cantilever strength. The engaging legs (44) and (45) work in cooperation with clamp opposing elements, described below. On the right side the right engaging leg (44) is opposed to a right narrow clamp (48) and a right wide clamp (46). On the left side, the left engaging leg (45) is opposed to a left narrow clamp (49) and a left wide clamp (47). Each of the engaging legs extend from the support skirt (60) and provide a horizontally disposed clamp surface opposed to a corresponding horizontal surface of a corresponding engaging leg (44) or (45). Each of the narrow clamps (48) and (49) is spaced apart from the engaging leg (44) or (45) to provide a narrow opening there between. The narrow opening dimension is approximately 0.8 inches in order to clamp onto a wooden step ladder rung which typically has a rung thickness of 0.75 inches. Each of the wide clamps (46) and (47) is spaced apart from the engaging leg (44) or (45) to provide a wide opening there between and the wide opening dimension is approximately 1.3 inches to clamp onto a fiberglass or aluminum ladder rung which typically has a rung thickness of 1.25 inches.

Referring now to FIG. 7, the bail handle (21) is, in a preferred embodiment, formed from a generally U-shaped wire element, with all legs substantially coplanar and integrally formed. Alternately, it should be noted, the bail handle could be non-coplanar and/or made of multiple elements. A tie-bar (76) forms a base of the U-shape which extends across the transverse dimension of the tray (20) and rests overhanging the support skirt (60) when the bail handle is in its default down position. The tie-bar (76) includes a center handle which may include a grip sleeve (77) attached to or installed over the tie-bar (76). In addition, the tie-bar may include opposing approximately 45 degree angled legs (80) and (81) surrounding the center handle to increase the tie-bar stiffness.

The bail handle (21) further includes a pair of opposing right and left arms (74) and (75) that extend longitudinally from the tie-bar (76) and the left and right arms (74) and (75) extend along the longitudinal length of the tray (20) slightly outboard of the right and left side walls (27) and (28). As best viewed in FIG. 4, each arm (74) and (75) includes a pivot portion (78) and (79). The pivot portions (78) and (79) comprise short legs that are substantially orthogonal to the corresponding left and right arm (74) and (75) and the pivot portions (78) and (79) extend inwardly along the transverse width. Each pivot portion (78) and (79) pivotally engages with a feature formed in the periphery flange lip (59) at a longitudinal location that approximately corresponds to the center of the deep well base (22). More specifically, the pivot portions (78) and (79) pivotally attach to the tray (20) proximate to the tray center of mass and preferably slightly forward of the tray center of mass. This is preferably true of the center of mass of the tray both when the tray is empty and when the tray contains fluid.

In the present example, the periphery flange lip (59) is formed with a right journal slot (52) and a left journal slot (53) sized to receive the pivot portions (78) and (79) therein with enough clearance to allow the pivot portions to rotate freely with respect to the journal slots. The slots (52) and (53) are formed on a bottom side of the periphery flange lip (59) and each slot include a corresponding right detent (50) and left detent (51) extending into the opening of the slot (52) or (53) at a lower end thereof and the detents narrow the opening to a dimension that is slightly less than the diameter of wire used to form the pivot portion. Accordingly, the detents (50) and (51) capture the pivot portions (78) and (79) within the slots (52) and (53). Alternately, it should be noted that other slot and detent schemes to capture the pivot portion of the bail handle are available. In addition, the periphery flange lip (59) is formed with a right stop (54) and left stop (55) positioned to abut the arms (74) and (75) during rotation of the bail handle (21) to thereby stop handle rotation at a desired maximum rotation angle.

In a first embodiment, the preferred maximum rotation angle is an acute angle to ensure that the lifted weight of the bail handle (21) returns the bail handle to the default horizontal position when the handle is released by the user. In addition, since the location of stops (54) and (55) determines the vertical orientation of the bail handle (21), a second embodiment is possible. Positioning stops closer to the front of the tray (20) will result in a second embodiment in which an obtuse angle position of the bail handle resulting in the bail handle remaining in a raised position when a hand is removed from the handle. The handle would remain in a raised position until deliberately returned to the horizontal position. In addition, it would be possible to provide adjustability, for example in right and left stops (54, 55) to allow customer selectability of bail handle angle.

Referring now to FIGS. 4 and 7, the bail handle (21) further includes right and left connectors (70) and (71) that extend substantially orthogonally from the pivot portions (78) and (79) along the longitudinal length of the tray (20) under the peripheral flange lip (59) toward the tray front end. The bail handle (21) further includes right and left foot extensions (72) and (73) that extend orthogonally outward from the right and left connectors (70) and (71) to a length that places the right and left foot extensions (72) and (73) outboard of the transverse width of the tray. When the bail handle (21) is in the default horizontal position, the right and left foot extensions (72) and (73) engage with bumper slots (56) and (57) formed in the underside of the peripheral flange lip (59) to retain the bail handle (21) in the default horizontal position. Alternately, it should be noted, the bumper slots can engage anywhere on the bail handle forward of the pivot portions.

As shown in FIG. 7, a user may use a foot to step on either one of the right and left foot extensions (72) and (73) to pivot the bail handle (21) from its default or horizontal position to a raised position as shown in FIG. 7. More specifically, the bail handle (21) can be pivoted to raise the tie-bar (76) and grip sleeve (77) to a more convenient height for grasping by a user. As noted above, the longitudinal position of the stops (54) and (55) control the rotation angle of the bail handle (21) and therefore the height to the handle above the tray (20). The user may grasp the grip handle (77) with one hand and lift the tray (20) using a substantially vertical lifting motion. This allows the user to lift the tray (20) with one hand while still holding a paint roller (or other object) in the other hand. In response to the lifting action, the tray (20) remains substantially horizontal so that it can be moved without spilling paint. In addition, since the handle of a paint brush supported on the rest surface (35) is substantially clamped in place by one of the brush holders (37), there is less chance that the brush will fall off the tray or fall into the paint reservoir as the tray is moved. In addition a user may lift the tray (20) off a floor surface using the bail handle and attach the tray to a ladder rung using the engaging legs (44) and (45) in cooperation with the narrow or wide clamps (46, 47, 48 and 49).

Figure 8:
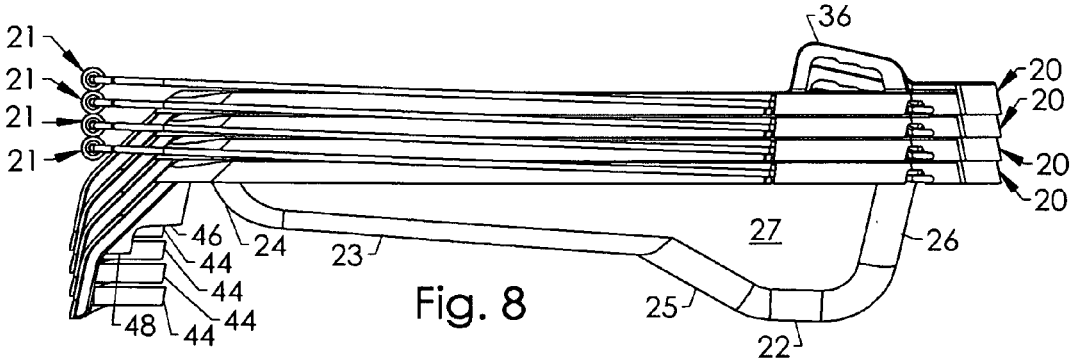
FIG. 8 is a right side plan view showing four tray assemblies stacked and nested.

Referring now to FIG. 8, the tray (20) is preferably configured for nesting one tray inside another for easy storage, convenient packaging and retail display.

It will be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications, e.g. as a paint roller tray, those skilled in the art will recognize that its usefulness is not limited thereto and that the present invention can be beneficially utilized in any number of environments and implementations where it is desirable to lift a horizontally disposed reservoir, apply liquid to a roller or store a wet paint brush in a secure manner. Accordingly, the claims set forth below should be construed in view of the full breadth and spirit of the invention as disclosed herein.

The invention claimed is:

1. A roller tray with a pivoting bail handle, said bail handle characterized in being suitable for carrying said tray while said tray contains a fluid; and wherein said bail handle further comprises at least one extension disposed outside of the reservoir portion of said tray, wherein said extension can be displaced to cause the bail handle to rise to a generally upright position, and wherein said extension is displaced by the action of a foot.

2. The tray of claim 1 wherein said bail handle and said extension are connected by a pivot portion.

3. The tray of claim 2 wherein said pivot portion is attached to the tray forward of the location of the center of mass of the tray when the tray contains fluid.

4. The tray of claim 2 wherein said pivot portion is attached to the tray forward of the location of the center of mass of the tray when the tray is empty.

5. The tray of claim 1 wherein the tray comprises stops, against which said bail handle may rest when not in use for carrying said tray.

6. The tray of claim 5 wherein said stops project beyond regions of said tray which hold fluid.

7. The tray of claim 1 wherein said tray comprises legs suitable for orienting said tray in a generally horizontal position on a surface.

8. The tray of claim 7 wherein said legs further comprise engaging means for affixing said tray to a ladder.

9. The tray of claim 1 wherein said bail handle carries a grip sleeve.

10. The tray of claim 1 further comprising at least one paint brush holder.

11. The tray of claim 1 further comprising at least one of a pour spout and a brush scraper.

12. The tray of claim 1 wherein said tray is nestable.

* * * * *